United States Patent [19]

Kasai

[11] Patent Number: 4,571,783

[45] Date of Patent: Feb. 25, 1986

[54] ADJUSTABLE STRAP FASTENER

[75] Inventor: Kazumi Kasai, Namerikawa, Japan

[73] Assignee: Nippon Notion Kogyo Co., Ltd., Tokyo, Japan

[21] Appl. No.: 687,583

[22] Filed: Dec. 28, 1984

[30] Foreign Application Priority Data

Dec. 20, 1983 [JP] Japan ..... 58-199964[U]
Feb. 25, 1984 [JP] Japan ..... 59-26140[U]

[51] Int. Cl.[4] ..... A44B 11/04

[52] U.S. Cl. ..... 24/200; 24/169; 24/193; 24/197

[58] Field of Search ..... 24/200, 197, 169, 182, 24/183, 193, 637, 643

[56] References Cited

U.S. PATENT DOCUMENTS

| | | | |
|---|---|---|---|
| 157,772 | 12/1874 | Tyson | 24/169 |
| 1,656,751 | 1/1928 | Myers | 24/200 |
| 1,920,549 | 8/1933 | Clark | 24/200 |
| 2,302,258 | 11/1942 | Rose et al. | 24/197 |
| 2,316,846 | 4/1943 | Diebold | 24/200 |
| 2,981,993 | 5/1961 | Elsner | 24/193 |
| 3,192,587 | 7/1965 | White | 24/200 |
| 3,349,449 | 10/1967 | Hatfield | 24/197 |
| 4,171,555 | 10/1979 | Bakker et al. | 24/200 |
| 4,395,803 | 8/1983 | Krauss | 24/200 |

FOREIGN PATENT DOCUMENTS 54-144244 11/1979 Japan .

*Primary Examiner*—Victor N. Sakran
*Attorney, Agent, or Firm*—Hill, Van Santen, Steadman & Simpson

[57] ABSTRACT

A strap fastener or buckle for connecting ends of a strap, belt or the like is adapted to enable adjustment of the effective length of the strap. The strap fastener is formed from a plastic material into an integrally molded structure having a grip head portion at one end and a connecting portion at the opposite end, these portions being connected by a pair of side flanges. A pair of spaced parallel cross bars extend between and are connected to the side flanges. The grip head portion has a sharply cornered bottom edge which serves as a stop for the strap. The cross bar which is disposed adjacent to the grip head portion has a plurality of sharp corners defining stops for the strap, one of the corners being disposed adjacent to the grip head portion and being spaced in plan view from the bottom edges by a distance larger than the thickness of the strap. The strap fastener is thus provided with multi-point stops along the path of the strap so that the strap can be retained firmly in place under heavy tension.

8 Claims, 17 Drawing Figures

ADJUSTABLE STRAP FASTENER

BACKGROUND OF THE INVENTION

1. Field of the Invention

This invention relates to a strap fastener for adjustably connecting a strap, belt or band to a variety of articles.

2. Description of the Prior Art

Various adjustable strap fasteners or buckles have been proposed which may be manipulated to adjust the effective length of a strap on for example a bag or a safety seat belt on a motor car.

Advanced such fasteners are made of a plastic material formed into an integrally molded structure which generally comprises a pair of opposing side flanges, a grip end portion at one end of the side flanges, an anchor end portion at the opposite end of the side flanges and a plurality of parallel cross bars disposed in between the grip and anchor end portions and extending transversely across between the side flanges. In use, one end portion of a strap or the like is looped about one of the cross bars, passed under the anchor end of the fastener and secured in place as by rivetting. The other end portion of the strap which is adapted for length adjustment is looped about another cross bar, passed under the grip end of the fastener and gripped therebetween against displacement. For ease of insertion or passage of the strap between the cross bar and the grip end portion, the gap therebetween is desirably the larger the better. Conversely, however, the larger the gap, the tendency will be greater for the strap to get loose under tension. Vice versa, this tendency is less the smaller the gap, but the insertion of the strap becomes more difficult.

A proposal has been made to thicken the fastener, or to incline the gap defining surfaces instead of enlarging the insertion gap, as disclosed in Japanese Patent Kokai (laid-open) Publication No. 54-144244. Such attempts are however not satisfactory in that the resulting fastener is costly and becomes unsightly.

SUMMARY OF THE INVENTION

It is an object of the present invention to provide an adjustable strap fastener made of a plastic material which is simple in construction and reliable in operation.

A more specific object of the invention is to provide an adjustable strap fastener which is relatively low in profile, yet capable of easy insertion of a strap or the like but resistant to force tending to loosen the strap from the adjustable strap fastener.

Another specific object of the invention is to provide an adjustable strap fastener which has multi-point stops for the strap to hold the same against displacement under heavy tension.

A further object of the present invention is to provide an adjustable strap fastener capable of holding a strap or the like against displacement with a holding force which increases as a tension on the strap or the like becomes greater.

A still further object of the present invention is to provide an adjustable strap fastener which can be manipulated with utmost ease.

A molded strap fastenere for adjustably connecting ends of a strap, belt or the like, comprises a grip head portion at one end and a connecting portion at the opposite end, these portions being connected by a pair of side flanges. A pair of spaced parallel cross bars extend between and are connected to the side flanges. The grip head portion has a sharply cornered bottom edge which serves as a stop for the strap. The cross bar which is disposed adjacent to the grip head portion has a plurality of sharp corners defining stops for the strap, one of the corners being disposed adjacent to the grip head portion and, as seen in plan view, being spaced from said bottom edge of the latter by a distance larger than the thickness of the strap. The strap fastener is thus provided with multi-point stops along the path of the strap so that the strap can be retained firmly in place under heavy tension.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

FIGS. 1 through 8 show an adjustable strap fastener generally designated 10 according to one embodiment of the present invention.

Figure 1:
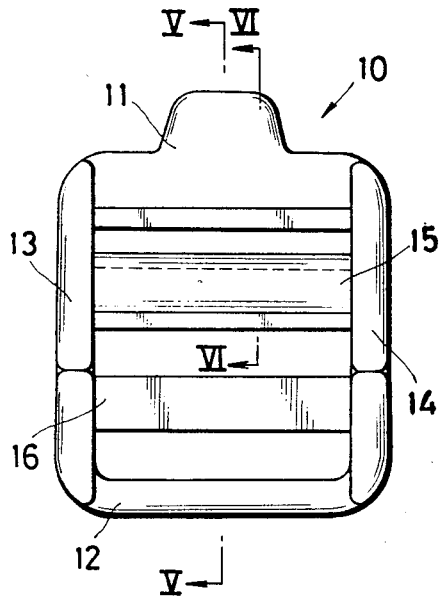
FIG. 1 is a front plan view of an adjustable strap fastener according to an embodiment of the present invention.
Figure 2:
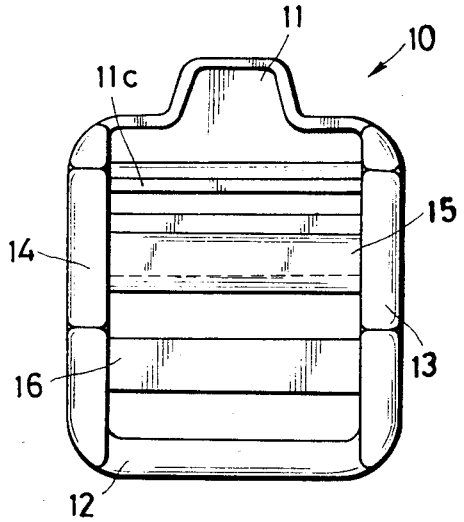
FIG. 2 is a bottom plan view of the strap fastener of FIG. 1.
Figure 3:
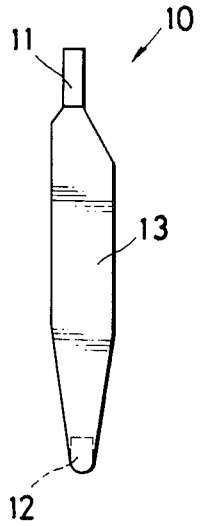
FIG. 3 is a side elevational view of the strap fastener of FIG. 1.

The strap fastener 10 is made of a synthetic resin or plastic material formed into an integral molded construction generally rectangular in shape as shown in FIGS. 1 and 2. The strap fastener 10 comprises a grip head portion 11 at one of its ends, a connecting portion 12 at the other end, a pair of opposed side flange portions 13, 14 extending longitudinally between and secured to opposite ends of the head portion 11 and the connencting portion 12, a first cross bar 15 adjacent to the head portion 11, and a second cross bar 16 adjacent to the connecting portion 12, the cross bars 15 and 16 extending in spaced parallel relation to each other between and connected to the opposed side flanges 13 and 14.

Figure 5:
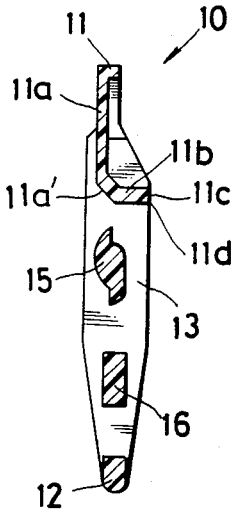
FIG. 5 is a cross-sectional view taken along the line V—V of FIG. 1.
Figure 4:
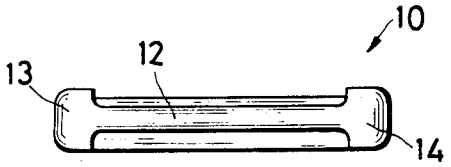
FIG. 4 is a back elevational view of the strap fastener of FIG. 1.

The head portion 11, as shown in FIG. 5, includes a projecting tab 11*a* of reduced thickness, a bevelled portion 11*a'* extending downwardly from the tab 11*a* at an angle, and a lower portion 11*b* extending from the bevelled portion 11*a'* downwardly substantially at a right angle to the plane of the fastener 10 adjacent the first cross bar 15, the lower portion 11*b* terminating with a flat bottom surface 11*c* lying flush with the bottom surfaces of the opposed side flanges 13, 14. The flat bottom surface 11*c* has a sharp corner 11*d* which serves as a first strap stop as later described.

The side flanges 13, 14 are tapered from the region of the second cross bar 16 toward the connecting portion 12.

Figure 6:
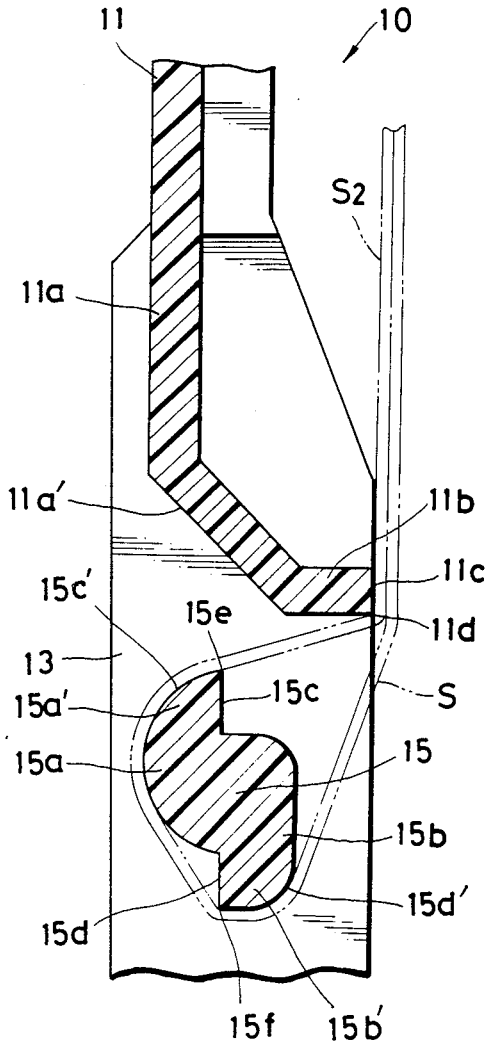
FIG. 6 is a cross-sectional view on enlarged scale taken along the line VI—VI of FIG. 1.

The first cross bar 15, as better shown in FIG. 6, includes a pair of integral top and bottom portions 15*a*, 15*b* displaced from one another in a direction parallel to the side flange portions 13 so as to provide a pair of first and second projections 15*a'*, 15*b'*. The first projection 15*a'* extends toward the grip head portion 11 and terminates in a second sharp corner edge 15*e* which is defined jointly by a flat bottom surface 15*c* and an arcuate top surface 15*c'*, while the second projection 15*b'* extends toward the connecting portion 12 and terminates in a third sharp corner edge 15*f* which is defined jointly by a flat top surface 15*d* and an arcuate bottom suraface 15*d'*. The flat bottom surface 15*c* of the first projection 15*a'* and the flat top surface 15*d* of the second projection 15*b'* extend in opposite directions from substantially the midpoint of the thickness of the cross bar 15, and also in a plane substantially parallel to the general plane of the fastener 10, the flat surfaces 15*c*, 15*d* lying slightly above the middle of the height of the side flange portion 13. The second sharp corner edge 15*e*, as seen in the plan, is spaced from the first sharp corner edge 11*d* by a distance larger than the thickness of the strap S. The second and third sharp corner edges 15*e*, 15*f* serves as second and third stops as later described.

Figure 7:
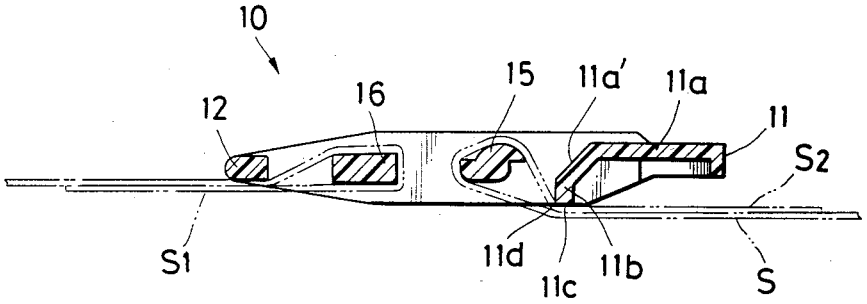
FIGS. 7 and 8 are schematic views utilized to explain the operative relations of the strap fastener and the strap.
Figure 8:
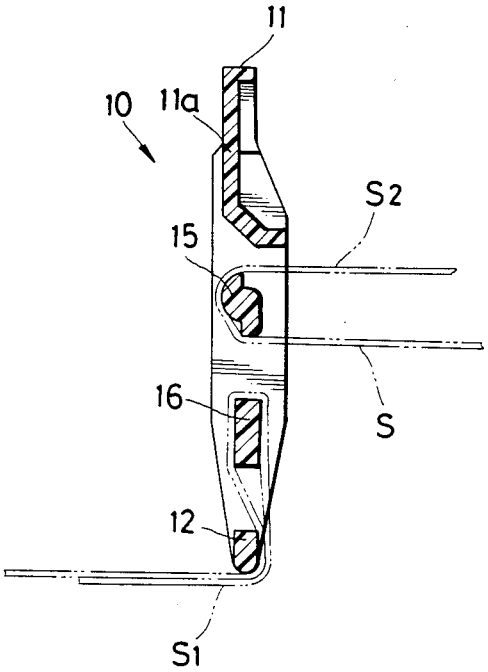

As better shown in FIG. 7, the strap or belt S so inserted into the strap fastener 10, first with one of its ends designated $S_1$ looped about the second cross bar 16 and passed underneath the connecting portion 12, the extension of the strap S at this end being secured in place as by rivetting or stitching. The other end of the strap designated $S_2$ is then looped about the first cross bar 15 and passed underneath the lower portion 11*b* of the head 11, in which instance the leading end portion of the strap $S_2$ is brought into contact with the flat bottom surface 11*c*.

While the strap end $S_1$ is held stationary, the strap end $S_2$ is adjustable in length to suit the particular application. This adjustment may be made by pulling out the leading strap end $S_2$ to shorten the effective length of the strap S as disposed in the condition of FIG. 7, or, shown in FIG. 8, by rotating the fastener 10 counterclockwise about the connecting portion 12 to release the strap end $S_2$ and enabling pulling the strap S out to shorten or in to lengthen the effective length of the strap S as desired.

The strap fastener 10 thus constructed is, as shown in FIG. 6, provided with multi-point stops, namely, at corners 11*d*, 15*e* and 15*f* along the path of the strap $S_2$ which is to be adjusted in length, so that the strap S is firmly held against displacement which would otherwise occur under the influence of heavy tension exerted in use. This multi-point stop arrangement permits an increase in the gap between the grip head 11 and the first cross bar 15 to facilitate insertion of the strap. Another advantage of the present structure is that the strap fastener 10 can be made to present a relatively low profile, which is esthetically and economically desirable.

Figure 9:
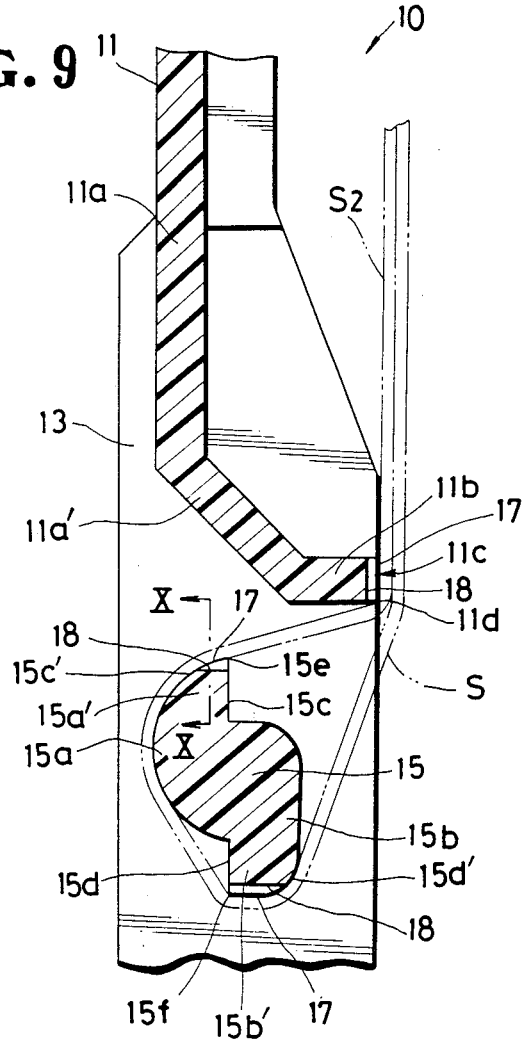
FIG. 9 is a view similar to FIG. 6 but showing another embodiment of the invention.
Figure 10:
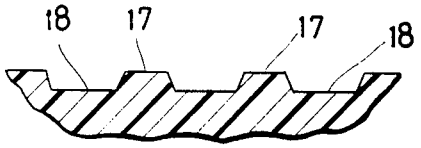
FIG. 10 is a cross-sectional view taken along the line X—X of FIG. 9.

FIGS. 9 and 10 illustrates a modification of the strap fastener 10 already described in which the only addition is the provision of alternate ridges 17 and grooves 18 for the regions of the head 11 with which the strap S comes in direct contact when mounted in normal use. Such regions comprise the flat bottom surface 11*c*, the arcuate top surface portion 15*a* and the bottom portion 15*b*. More specifically, the bottom surface 11*c* has throughout the length thereof the ridges 17 and the grooves 18 extending parallel to the side flange portion 13. The ridges 17 and the grooves 18 are also provided at the sharp corners 15*e*, 15*f* of the first cross bar 15 and extend normal to the general plane of the fastener 10. This ridge-and-groove arrangement increases to the effect of gripping the inserted strap S.

Figure 11:
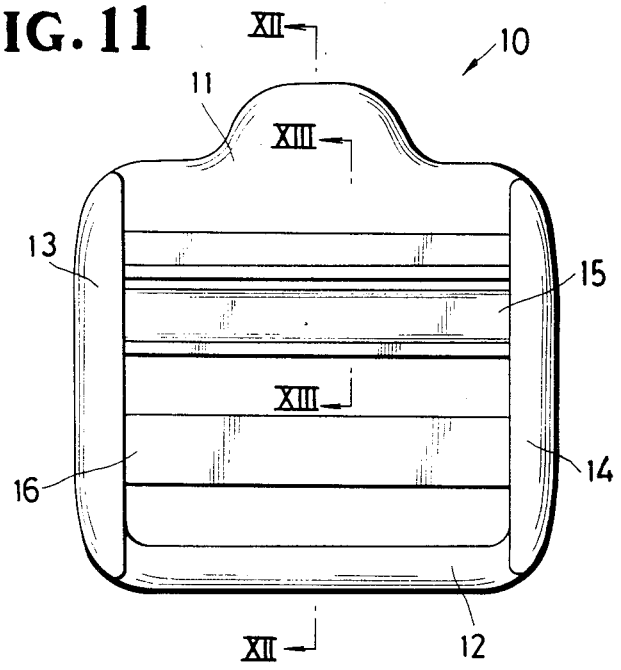
FIG. 11 is a view similar to FIG. 1 but showing a further embodiment of the invention.
Figure 12:
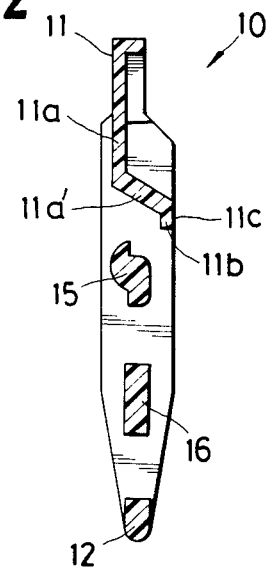
FIG. 12 is a cross-sectional view taken along the line XII—XII of FIG. 11.
Figure 13:
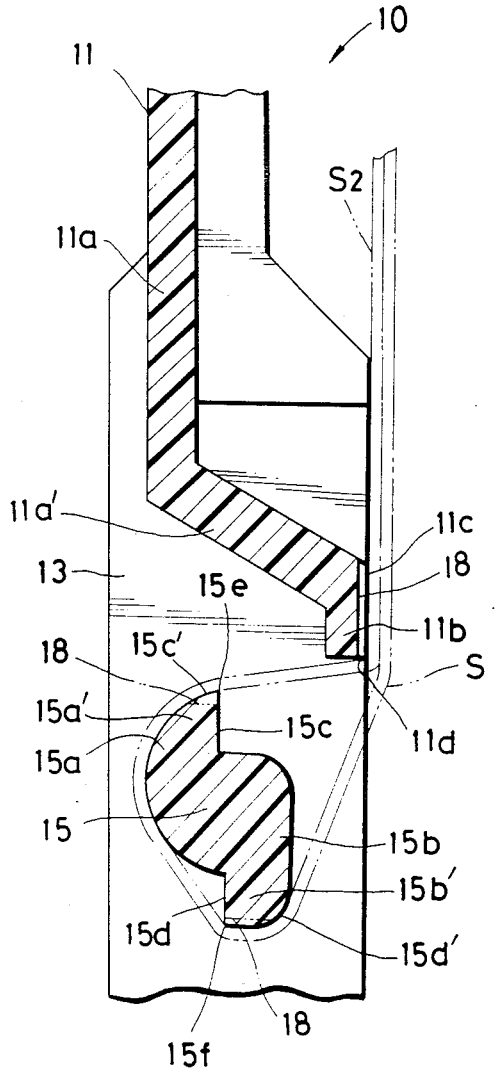
FIG. 13 is a cross-sectional view taken along the line XIII—XIII of FIG. 11.
Figure 14:
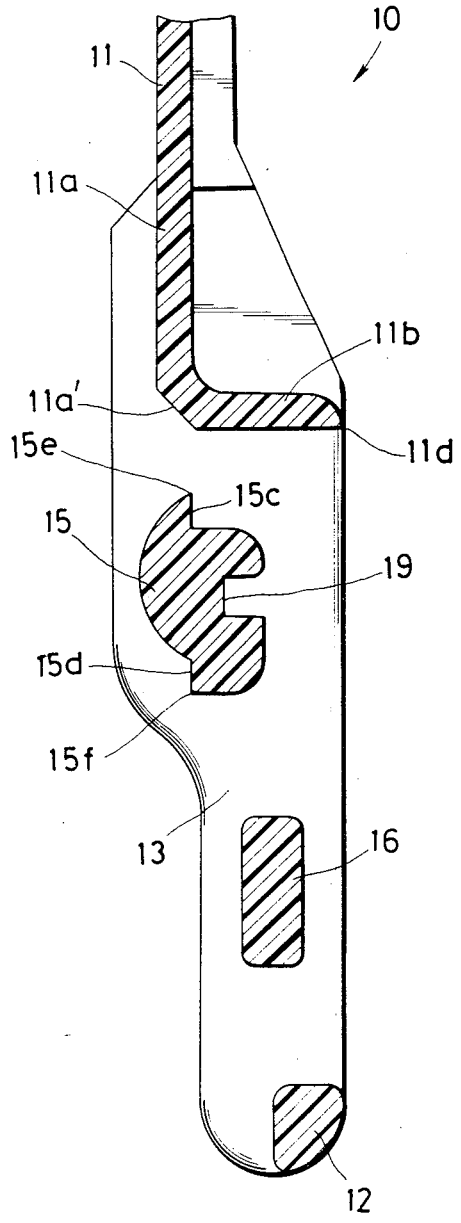
FIGS. 14–17 inclusive illustrate still another modification of the strap fastener according to the invention.
Figure 15:
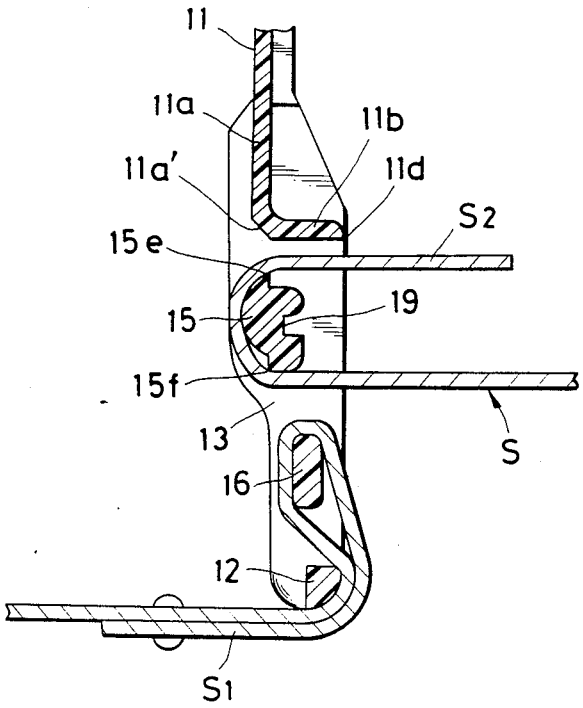

FIGS. 11, 12 and 13 inclusive show another modification in which the lower portion portion 11*b* of the head 11 extends toward the first cross bar 15 in parallel relation to the side flange portion 13 with the result that the bottom surface 11*c* is enlarged also toward the first cross bar 15, the arrangement being provided to improve the gripping effect. The sharp corner 11*d* of the lower portion portion 11*b* is spaced from the sharp corner 15*e* of the cross bar 15, as seen in plan view, by a distance which is larger than the thickness of the strap or belt S. The ridge-and-groove arrangement of FIGS. 9 and 10 may also be combined to further enhance the gripping effect.

Figure 16:
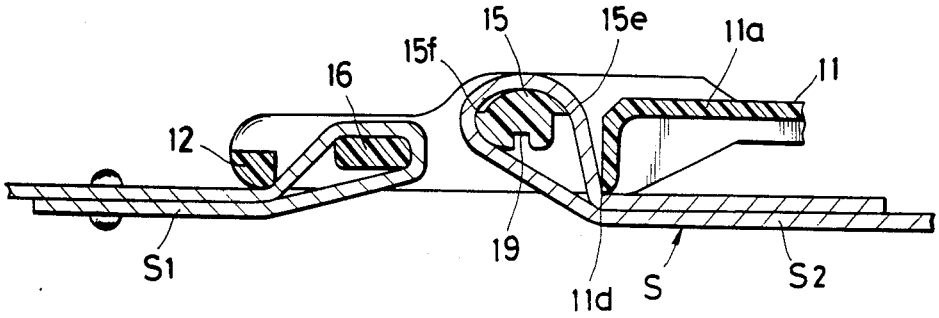
Figure 17:
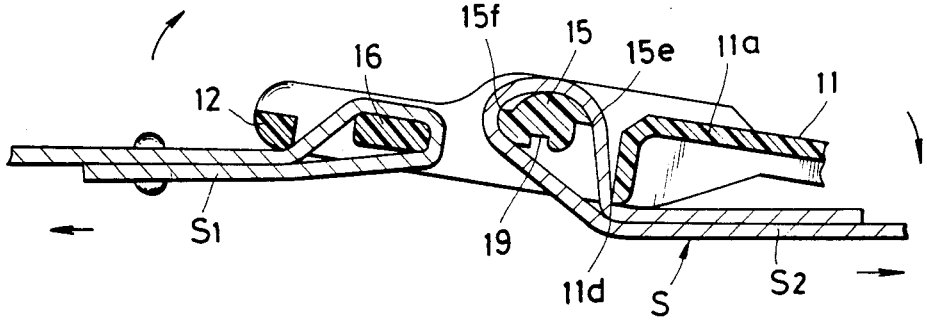

FIGS. 14, 15, 16 and 17 inclusive show a further modification of the strap fastener 10 in which the first cross bar 15, the second cross bar 16 and the connecting portion 12 are disposed out of alignment with respect to the general plane of the strap fastener 10. This is better illustrated in FIG. 14 from which it will be understood that the second bar 16 is displaced above the level of the connecting portion 12 and the first cross bar 15 is displaced slightly above the level of the second cross bar 16. The connecting portion 12 has a bottom surface lying flush with the bottom surfaces of the side flanges 13, 14. The first cross bar 15 is recessed as at 19 throughout the length thereof for saving the amount of synthetic resin material used. In this embodiment, each of the flange portions 13 is thickened at a region supporting the cross bar 15 and the head portion 11, and the flat surfaces 15*e*, 15*f* of the cross bar 15 extend substantially flush with the top surface of the flange portion 13. This arrangement, as appears clearly from FIGS. 16 and 17, provides a tendency for the rotational force upon the connecting portion 12 to orient toward the top of the fastener 10 and for the rotational force upon the lower portion portion 11*b* to orient toward the bottom of the fastener 10. This tendency becomes greater the larger the tension applied to the strap S, thus ensuring firm anchorage of the strap S even when the same is roughly handled.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A strap fastener molded of synthetic resin for adjustably connecting ends of a strap or the like, comprising:

(a) a grip head portion;

(b) a pair of parallel spaced side flange portions extending from said grip head portion in a common direction and having respective bottom surfaces;

(c) a connecting portion extending perpendicularly to said side flange portions and interconnecting them at their distal ends;

(d) a pair of parallel spaced first and second cross bars extending parallel to said connecting portion and joined with said side flange portions, said first cross bar being disposed adjacent to said grip head portion;

(e) said grip head portion having a first sharp corner edge disposed adjacent to said first cross bar and lying flush with said bottom surfaces of said side flange portions; and (f) said first cross bar including a pair of integral top and bottom portions displaced from one another in a direction parallel to said side flanges, said top portion having a first projection extending toward said grip head portion and terminating in a second sharp corner edge, said bottom portion having a second projection extending toward said connecting portion and terminating in a third sharp corner edge, said first projection having a top surface and a flat bottom surface merging together to jointly define said second sharp corner edge, said second projection having a flat top surface and a bottom surface merging together to jointly define said third sharp corner edge, said flat bottom surface and said flat top surface of said first cross bar lying in a plane extending parallel to the general plane of said strap fastener and substantially containing the longitudinal central axis of said first cross bar, said first and second sharp corner edges in plan view being spaced from one another by a distance larger than the thickness of the strap or the like.

2. A strap fastener according to claim 1, said grip head portion having a bottom surface lying flush with said bottom surfaces of said side flange portions and partly defining said first sharp corner edge, said bottom surface having throughout the length thereof alternate ridges and grooves intersecting said first corner edge.

3. A strap fastener according to claim 1, said first cross bar having throughout the length thereof alternate ridges and grooves extending normal to the general plane of said strap fastener across said second sharp corner edge.

4. A strap fastener according to claim 1, said first cross bar having throughout the length thereof alternate ridges and grooves extending normal to the general plane of said strap fastener across said third sharp corner edge.

5. A strap fastener according to claim 1, said grip head portion having a beveled portion facing toward said second sharp corner edge, and a lower portion extending from said beveled portion at a right angle to the general plane of said strap fastener and terminating with a bottom surface lying flush with said bottom surfaces of said side flange portions, said bottom surface of said lower portion of said grip head portion partly defining said first sharp corner edge.

6. A strap fastener according to claim 1, said grip head portion having a beveled portion facing toward said second sharp edge, and a lower portion extending from said beveled portion toward said first cross bar in parallel relation to said side flange portions, said end of said lower portion defining said first sharp corner edge.

7. A strap fastener according to claim 1, said connecting bar, said second cross bar and said first cross bar lying in three planes, each spaced from the plane of said bottom surfaces.

8. A strap fastener according to claim 1, the lowermost portions of said connecting bar and said grip head portion lying in the same plane.

* * * * *